United States Patent [19]

Williams et al.

[11] Patent Number: 5,023,116

[45] Date of Patent: Jun. 11, 1991

[54] ENVIRONMENTALLY ACCEPTABLE PROCESS AND APPARATUS FOR VENTILATION OF CONTINUOUS PAINT LINES

[76] Inventors: Larry Williams, 644 E. Fairway Dr., Redlands, Calif. 92373; William Hunter, 13588 Pyramid Dr., P.O. Box SVL 542, Victorville, Calif. 92392

[21] Appl. No.: 391,104

[22] Filed: Aug. 7, 1989

[51] Int. Cl.[5] ..... B05D 1/00

[52] U.S. Cl. ..... 427/424; 118/326; 118/DIG. 7; 98/115.2

[58] Field of Search ..... 118/326, DIG. 7; 98/115.2; 427/424

[56] References Cited

U.S. PATENT DOCUMENTS

| | | | |
|---|---|---|---|
| 3,077,422 | 2/1963 | Slatkin | 117/104 |
| 3,563,203 | 2/1971 | Stiltner | 118/326 |
| 4,266,504 | 5/1981 | Roesner | 118/314 X |
| 4,313,369 | 2/1982 | Tsuruta et al. | 118/326 X |
| 4,587,927 | 5/1986 | Beierling et al. | 118/326 |
| 4,664,061 | 5/1987 | Morioka et al. | 118/326 X |
| 4,668,268 | 5/1987 | Lindner et al. | 118/314 X |
| 4,750,412 | 6/1988 | Itou | 118/326 |

OTHER PUBLICATIONS

Brochure: "efs Auto-Roll", published by Clear-Aire Corp.

*Primary Examiner*—Shrive Beck
*Assistant Examiner*—Alain Bashore
*Attorney, Agent, or Firm*—Gregory O. Garmong

[57] ABSTRACT

Organic vapor and particulate matter resulting from spray painting in continuous painting lines are separately collected and disposed of in a closed painting system that permits access for touch up. The painting line typically includes an automatic painting booth, a touch up booth, a flash off tunnel, and a curing oven, and a conveyer that conveys objects to be painted through the line in that order. The automatic painting booth recirculates air through a filter and through the booth to maintain proper painting conditions, and is tightly closed except for the conveyer entrance. The touch up booth has an opening through which workers have access to the painted objects, and through which a makeup flow of air is drawn to prevent particulate and organic compounds from escaping. The make up airflows to the automatic painting booth. A portion of the flow of organic-laden air is withdrawn from the automatic painting booth to maintain the air within the booth at a safe organic concentration level, and burned.

9 Claims, 3 Drawing Sheets

10
12
14
16
18
20
22
24
26
28
30
32
34
36
38
40
42
48
52
54
58
62
64
66
68
70
90

ENVIRONMENTALLY ACCEPTABLE PROCESS AND APPARATUS FOR VENTILATION OF CONTINUOUS PAINT LINES

BACKGROUND OF THE INVENTION

This invention relates to industrial painting lines, and, more particularly, to the ventilation of such lines to collect and dispose of organic compounds and particulates.

In one type of industrial painting line, objects that have previously been formed or processed to shape are placed onto a conveyer and passed through stationary painting booths and a curing facility. The painting booths typically include an automatic painting booth in which a robot applies a coat of paint, followed by a touch up booth where a worker applies paint to areas such as the interior of channels which might be missed by the automatic applicator. It is common practice to have two or more automatic booths and two or more touch up booths, so that the different sides and faces of the object can be painted without turning the object, or so that multiple coats of paint can be applied. After painting, the conveyer moves the objects into a flash off tunnel, where a portion of the volatile organic compounds (VOCs) in the paint are vaporized, and then to the curing oven where the paint is cured to a hard, dry state.

Many different types of paints are available, including organic-based, water-based, and mixed types. (As used herein, the term "paint" is to be interpreted broadly to include all coatings that contain particulates and organic compounds, and without a narrow meaning as may be found in some fields.) Experience has shown that for many painting applications, such as the painting of aluminum, a relatively high organic content of the paint results in the best quality of the painted product. As an example, an organic-based paint producing a high-quality finish on aluminum may contain about 5.5 pounds of volatile organic compounds per gallon, while paints producing lower quality finishes on aluminum may contain 1.5 pounds of organics per gallon or less.

Unfortunately, the high-organic content paints also have the greatest potential for atmospheric pollution. Such paints include both particulate and vaporizable organic compounds, which can escape to the atmosphere during the painting operation. When the painted object passes through the flash off tunnel and the curing oven, organic vapor is evolved. Although the applicator heads in the automatic and touch up booths are configured to deposit a large fraction of the paint onto the objects being painted, inevitably some misses. Both particulate and organic vapor are thereby introduced into the atmosphere.

In much of the United States and in many foreign countries, it is common practice simply to permit the release of the vaporized organic compounds to the environment. Other areas have placed strict limits on the amounts of allowable organics that may be released. For example, in Riverside County of Southern California under rules of the South Coast Air Quality Management District (SCAQMD), the present limit on the release of organics to the atmosphere is 68 pounds per day. A painting line operator may use the high-organic content paint having 5.5 pounds of volatile organic compounds per gallon and producing a high-quality finished product, but is limited to an organic compound loss per day equivalent to that found in only 12.4 gallons of paint. If the operator chooses to use the paint having 1.5 pounds of volatile organic compounds per gallon, the result is a lower-quality finished product, but the operator is permitted an organic compound loss per day equivalent to that found in 45.3 gallons of paint. The environmental laws therefore place the operator in the position of choosing a lower volume, high quality operation, or a higher volume, lower quality operation. It is expected that in the future such organic emissions limitations will become more widely legislated and more strict, throughout the United States and other parts of the world. Moreover, painting line operators may be required to adopt the best available technology, regardless of the rules that apply otherwise.

Federal and state occupational health and safety laws also play a major part in painting line design and operation. Persons who work in such facilities must be protected against overexposure to organic vapors with sufficient ventilation of the workplace. Also, the areas where combustibles such as organic vapors are present must maintained well below the lower explosive limit for the organic-containing vapor.

Thus, painting lines must be operated in compliance with environmental laws and the health and safety laws, and in a manner that produces a high-quality product as economically as possible. Industries located in areas that have strict environmental and health and safety laws are placed in a difficult competitive position against those which are not so located, for example, those in many foreign countries.

There have been attempts to provide painting line systems that permit operation in compliance with the laws, and that also allow the use of paints with high levels of volatile organic compounds. However, in most instances these approaches have not been economically realistic for the types of painting systems discussed above, and there remains a need for such paint line systems. The present invention fulfills this need, and further provides related advantages.

SUMMARY OF THE INVENTION

The present invention provides a continuous painting line system that achieves total, 100 percent efficiency for the collection of volatile organic compounds, complies with health and safety laws, and produces a painted product of high quality. It may be operated in conjunction with a high-efficiency organics combustor that destroys a large fraction of the VOCs, with the result that only 1–2 percent or less of the volatile organic compounds not remaining on the painted objects are exhausted to the atmosphere, as compared with 10–30 percent or more in most prior operations. The painting line system of the invention is structured and operated so that the required VOC combustor is relatively small in size, and therefore of low capital cost, and is inexpensive to operate. Because of the high overall organics removal efficiency, the painting line operator has greater flexibility than heretofore available in choosing a combination of large size and high throughput, and use of high-organic content paints.

In accordance with the invention, painting apparatus for painting objects passed therethrough continuously comprises a first painting booth through which the objects pass and in which paint is applied in a first painting direction at a first paint flow rate, the first painting booth including means for recirculating a recirculation flow of air from one side of the first painting booth to the other, so that the air flows through the first painting booth in the first painting direction; a second painting booth through which the objects pass after passing through the first painting booth, and in which paint is applied at a second paint flow rate; means for forcing a makeup flow of air from the second painting booth to the first painting booth with a volume flow rate such that the organic content of the air in the second painting booth is less than its lower explosive limit; withdrawal means for withdrawing a flow of air from the first painting booth; and control means for controlling the flow rate of air withdrawn by the means for withdrawing such that the organic content of the air in the first painting booth is less than its lower explosive limit.

The invention also encompasses a process for operating such an apparatus to achieve a maximum operating efficiency and reduction of organics emitted to the atmosphere. In accordance with this aspect of the invention, a process for painting objects that pass through a painting apparatus in a continuous manner comprises the steps of furnishing a first closed painting booth having an entry opening, the first painting booth having a painting applicator that forces organic-containing paint toward the objects in a first painting direction, and further having a semi-permeable paint filter through which the paint not deposited upon the objects is directed, a second painting booth connected to the first painting booth, the second painting booth having a painting applicator that sprays organic-containing paint toward the objects, and a conveyer that moves the objects into the first painting booth through the entry opening and thereafter into the second painting booth; recirculating air through the first painting booth, the air flowing in the first painting direction within the first painting booth, at a rate sufficiently high to force paint-laden air through the filter; providing a flow of make up air to the first painting booth from the second painting booth, the make up air being drawn from the second painting booth at a rate sufficiently high to prevent applied organics from escaping from the second painting booth; and withdrawing a portion of the recirculated air from the first painting booth at a rate such that the organics content of the air in the first painting booth is below the lower explosive level, such that the linear flow rate of air through the entry opening is sufficiently high to prevent sprayed organics from escaping from the second painting booth, and such that the volumetric flow rate of air withdrawn is substantially equal to the volumetric flow rate of make up air plus the volumetric flow rate of air entering the first painting booth through the entry opening.

The invention further extends to a filter apparatus that is particularly useful in filtering the recirculated air in the first or automatic painting booth. In accordance with this aspect of the invention, apparatus for filtering particulate matter from organic-laden air comprises an endless belt of a mesh material; a pair of spaced apart end rollers over which the endless belt passes, the portion of the belt between the rollers defining a filtering region; a drive motor that drives the end rollers so that the endless belt travels thereover; a strip of a semi-permeable material that traps organic particulate therein when a flow of organic-laden air is passed therethrough, the strip being supported upon and travelling with the endless belt through the filtering region; a payout roller upon which the strip is wound prior to payout onto the endless belt; a takeup roller which receives the strip as it leaves the endless belt; means for directing a flow of organic-laden air through the strip of semi-permeable material in the filtering region; and a housing that completely encloses the endless belt, the end rollers, the strip of semi-permeable material, the payout roller, the takeup roller, and the means for directing. Preferably, a seal is disposed around the filtering region to ensure that the air flow passes through the filtering region and cannot bypass it.

The process and apparatus of the invention provide a highly efficient, low cost approach to painting a continuous flow of objects. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

In accordance with a preferred embodiment of the invention, painting apparatus for painting objects passed therethrough continuously comprises a painting line, including an automatic painting booth having an automatic painting head therein that directs paint toward the objects to be painted in a painting direction, and having an entrance opening through which the objects pass to enter the painting line and which admits an entrance opening flow of air, but which is otherwise closed, a touch up booth having a manual painting head and an access opening providing access for a worker to the interior of the touch up booth to perform manual touch up operations, and which is joined to the automatic painting booth, a flash off tunnel through which the objects pass, and which is joined to the touch up booth, a curing oven through which the objects pass, and which is joined to the flash off tunnel, and further having an exit opening through which the objects pass to leave the painting line, and a conveyer upon which the objects are supported, and which conveys the objects through the automatic painting booth, the touch up booth, the flash off booth, and the curing oven, in that order; and an automatic painting booth ventilation system, including a recirculation duct that extends from one side of the automatic painting booth to the other, a recirculation blower that recirculates a recirculation flow of air through the recirculation duct and thence through the automatic painting booth in the painting direction, a makeup air duct extending from the touch up booth to the automatic painting booth, a makeup air blower that forces air through the makeup air duct, a collection plenum, a valve in the recirculation duct that permits a controllable volume of air to flow from the recirculation duct into the collection plenum, a filter through which the recirculation flow of air passes, means for forcing a flow of air from the flash off tunnel to the collection plenum, and means for forcing a flow of air from the curing oven to the collection plenum.

Figure 1:
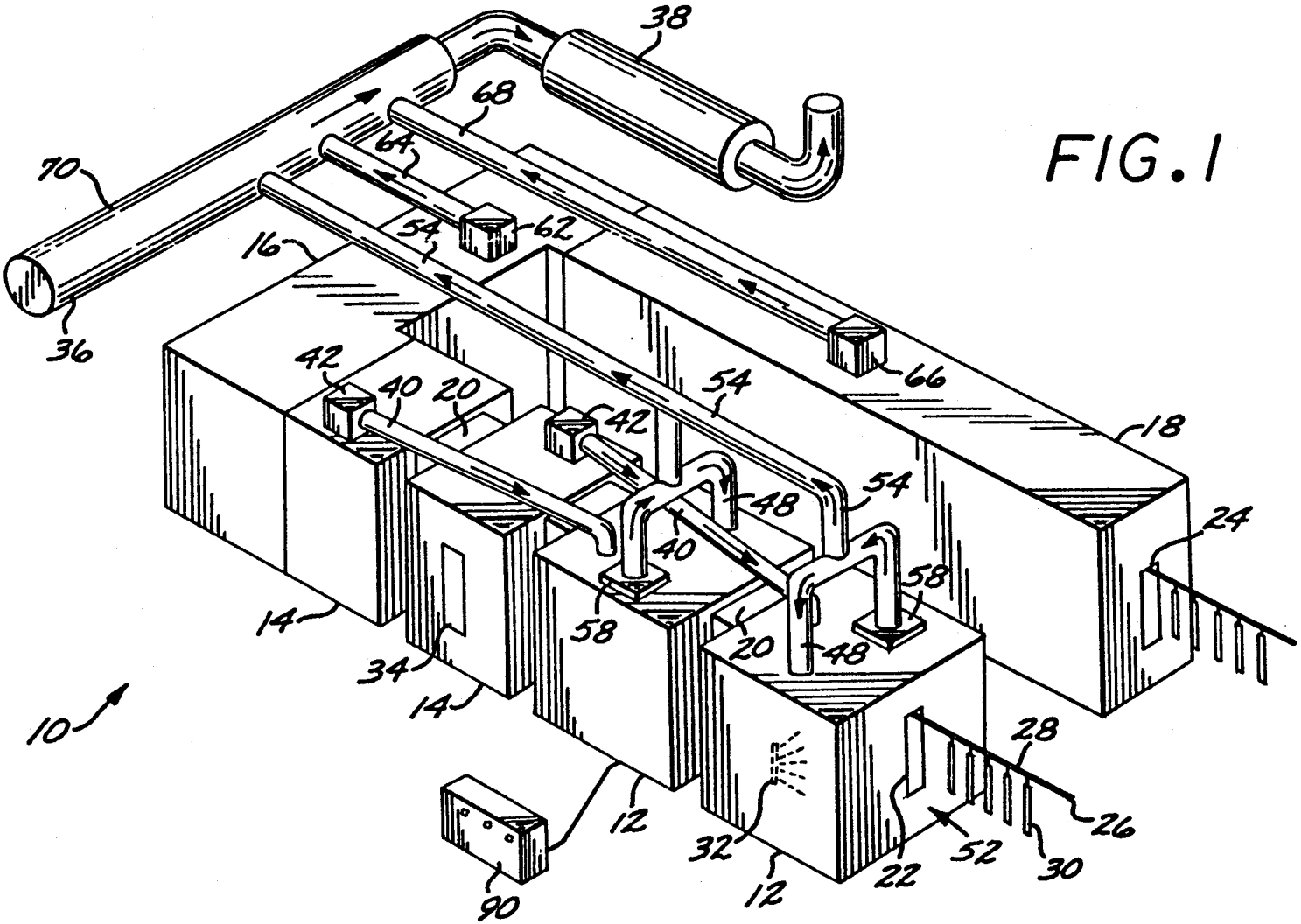
FIG. 1 is a schematic perspective view of a preferred embodiment of the apparatus of the invention, with the air flow paths indicated.

A preferred form of painting apparatus 10 is illustrated in FIG. 1. The apparatus 10 includes a painting line, having, in order from the beginning of the line, two automatic painting booths 12, two touch up booths 14, a flash off tunnel 16, and a curing oven 18. Two automatic painting booths 12 and two touch up booths 14 are provided so that the objects to be painted can be sprayed from one side in the first painting booth and the first touch up booth, and on the other side in the second painting booth and the second touch up booth. Between the booths is a closed passage 20. These components are preferably arranged in a generally U-shaped plan to conserve floor space, with the booths 12 and 14 on one leg, the curing oven 18 on the other leg, and the flash off tunnel 16 at the base of the U.

An entrance opening 22 is provided in the first painting booth 12 at the end of one leg of the U, and an exit opening 24 is provided in the curing oven 18 at the end of the other leg of the U. A conveyer 26, illustrated as a track 28 upon which objects 30 to be painted are suspended, enters the apparatus 10 through the entrance opening 22, extends through the booths 12 and 14, the flash off tunnel 16, and the curing oven 18, and exits the apparatus 10 through the exit opening 24. The objects 30, suspended on the track 28, are slowly and continuously moved through the painting booths 12 and 14, the flash off tunnel 16, and the curing oven 18 serially.

One automatic painting booth 12 contains a robot painting applicator 32 facing transverse to the conveyer track 28 in one direction, and the other automatic painting booth 12 contains a similar robot painting applicator facing transverse to the conveyer track 28 in the other direction. The applicator 32 may typically be a spray painting head or a turbo bell head that forces paint against a rapid turning disk, which then flings the atomized paint toward the objects to be painted. The painting applicators 32 apply most of the paint to the objects to be painted, and achieve a reasonable degree of coverage.

However, experience has shown that many types of objects 30, such as channel sections for example, require some touch up to ensure that the bottom of the channel is covered with paint. Each touch up booth 14 has at least one access opening 34 in its side, on the side corresponding to the respective applicator head 32. That is, each side of the object 30 receives both an automatic painting and a touch up. A skilled touch up worker, who has access to the objects 30 through the access opening 34, can ensure full paint coverage of the objects 30. The volume of paint applied in the touch up booths 14 is less than, and typically about 1/5 of, the amount of paint applied in the automatic painting booths 12.

FIG. 1 also illustrates the overall view of a ventilation system 36 for the booths 12 and 14, the flash off tunnel 16, and the oven 18. The ventilation system 36 directs air flows through the booths, the flash off tunnel, and the oven to ensure that a large portion of the volatile organic compounds in the paint that does not permanently deposit upon the objects 30 is collected, and cannot be exhausted to the atmosphere. Paints typically have several components, including pigments, binders, solvents, and additives. The pigments are usually particulate matter such as metal oxides or carbon black. The binders are typically organic compounds, at least some portion of which may be volatile, such as acrylics or urethanes. The solvents are usually organic compounds that are highly volatile for ease of removal, such as toluene or methylethylketones (MEK). Typical additives include catalysts and surface active agents. The particulate matter not deposited on the paint is collected in a filter, while the volatile organic compounds are collected by the ventilation system and destroyed in a combustor.

The volatile organic compounds produced within the painting apparatus 10 are captured by the ventilation system 36. The automatic painting booths 12, touch up booths 14, flash off tunnel 16, and curing oven 18 are made as gas tight as reasonably possible within the limitations of large scale, reasonable cost construction. That is, the booths and oven are closed with fastened sheet metal, so that large flows of vapor cannot readily escape. This approach is to be contrasted with most prior continuous painting operations, where the painting and curing facilities are open to the air.

Additionally, air flows that draw the organic vapors into a series of ducts and ultimately to a gas combustor 38 are induced by blowers. The blowers create slight negative pressures within the booths, the tunnel, and the oven, so that air is drawn into the painting booths, the flash off tunnel, and the oven and so that the volatile organic compounds cannot escape through the walls or cracks that may remain. The openings 22, 24, and 34 are intentionally placed into the painting apparatus 10, but the sizes of the openings and the air flow rates are mutually selected so that the inward flow of air through the openings is sufficiently large that the volatile organic compounds cannot diffuse out of the openings. Consequently, workers who operate the touch up booths or who may be working near the apparatus 10, as those who load and unload the objects 30, are not exposed to outwardly diffusing organic vapors. This approach consequently meets health requirements.

The approach of the invention also meets safety requirements. The gas flow rates are calculated and maintained so that organic levels in the air cannot exceed the lower explosive limit (LEL), and typically are at most about 25 percent of the LEL for volatile organic compounds in the paint line. The content of volatile organic compounds is preferably maintained much lower in most parts of the system, however, at a maximum of about 25 percent of the LEL. The organic content of the air can vary at different locations in the system, and tends to be higher in the ducts near the automatic painting booths.

A high air flow rate from the paint head 32 toward the objects 30 being painted in the automatic painting booths 12 also promotes good quality of the painted parts. The flow of air aids in transporting the paint particles to the objects being painted. Additionally, the flow rate of the air and its resulting pressure differential across the filter must be sufficiently high to force it through an air filter within the automatic painting booths 12, whose construction and operation will be discussed in relation to FIGS. 2 and 3. A pressure differential across the filter of about 3 inches of water column is preferred. If the flow rate and the pressure insufficient, the air will not be properly filtered, and the quality of the finish of the objects 30 may be reduced.

The meeting of the the health and safety requirements and the quality requirements suggests having large flows of air through the ventilation system 36. However, there is a strong disincentive to such large air flows to the combustor 38 because of environmental restrictions. To combust and destroy the volatile organic compounds to a form wherein they are environmentally acceptable for release to the air, they must be heated to a sufficiently high temperature for a short time. For example, the SCAQMD code requires that the volatile organic compounds be heated to at least 1400° F. for at least ½ second to accomplish their destruction. The more air mixed with the vapors, the larger the combustor must be and the higher the fuel use to heat the mixture to the required combustion temperature. Otherwise, the combustor becomes inefficient and the organic vapor is not properly combusted. The diluting air in the mixture must be heated along with the organic vapor, and therefore it would be preferable to have a low air content in the mixture.

The present ventilation approach provides the required high air flow rates where necessary for health, safety, and quality reasons and a low air flow rate to the combustor.

Air drawn into the touch up booths 14 is directed to the automatic painting booths 12 through ducts 40. A blower 42 draws air through the access opening 34 into each touch up booth 14 and forces it along the duct 40 in a volume such that the linear flow rate through the access opening 34 is sufficiently high that organic vapor from the touch up operation cannot pass out the opening 34. The required volumetric flow rate is readily calculated by multiplying the area of the access opening times the linear flow rate necessary to prevent escape of the volatile organic compounds, which typically is about 100 feet per minute. For example, if the access opening has an area of 24 square feet (e.g., 6 feet by 4 feet in size), and the required linear flow rate is 100 feet per minute, the required volumetric flow rate is 2400 cubic feet per minute (cfm). The air flow volume is usually maintained slightly above that calculated to provide a small margin of error, but an excessively large volumetric flow rate is avoided.

In the preferred embodiment, there are two touch up booths 14 and two automatic painting booths 12. The preferred ventilation system is divided into two parallel subsystems. The duct 40 from the first touch up booth 14 (which is the third booth through which the objects 30 pass) extends to the first automatic painting booth 12 (which is the first booth through which the objects 30 pass). The duct 40 from the second touch up booth 14 (which is the fourth booth through which the objects 30 pass) extends to the second automatic painting booth 12 (which is the second booth through which the objects 30 pass).

Figure 2:
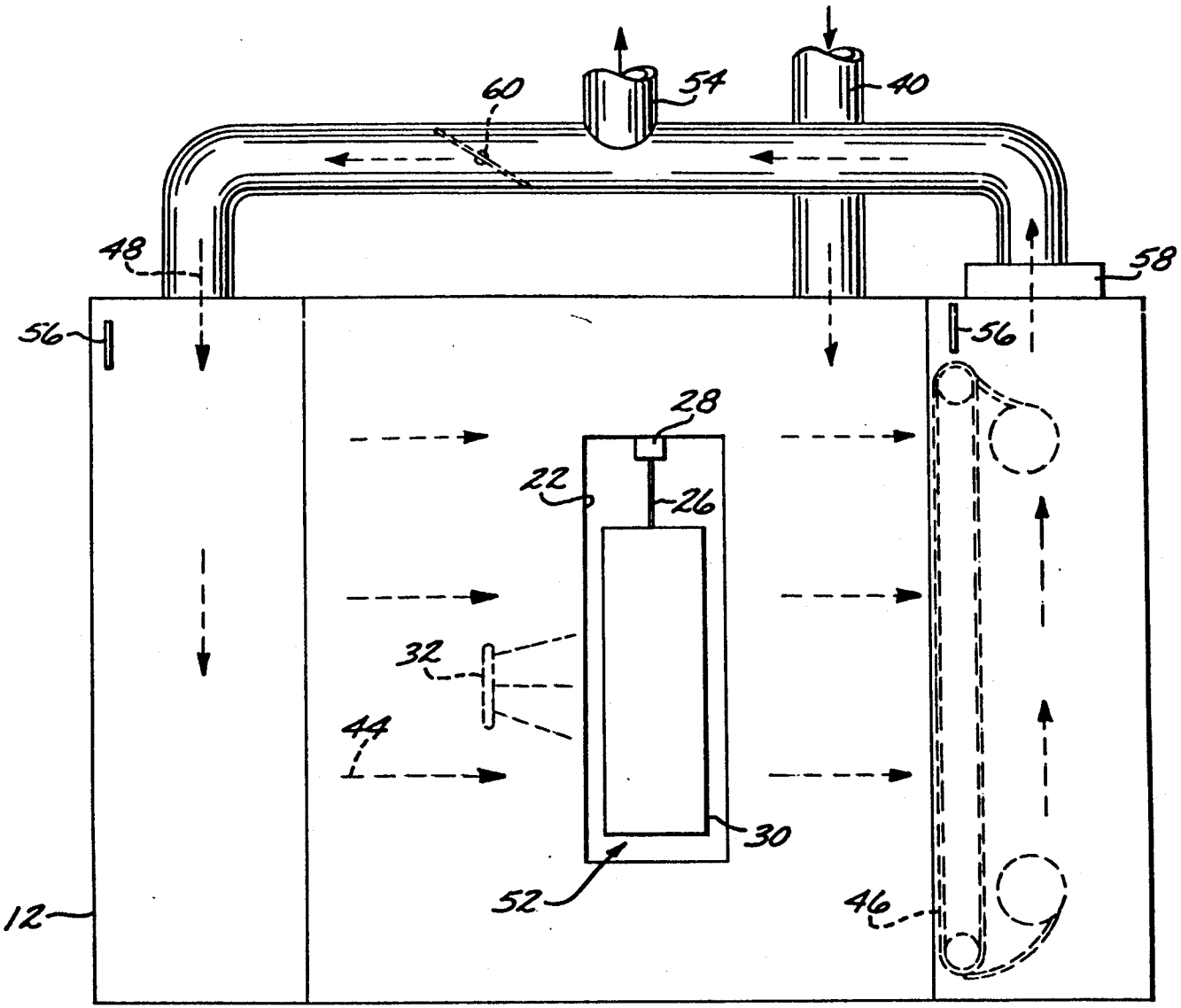
FIG. 2 is a diagrammatic end sectional view of an automatic painting booth, with air flow paths indicated.

The automatic painting booth 12, and the air flows therein, are illustrated in FIG. 2. The objects 30 pass through the interior of the booth 12 on their conveyer 26. The automatic paint applicator head 32 directs a stream of paint toward the objects 30, in a painting direction 44. In many applications, the paint head 32 electrically charges the paint droplets, and the objects 30 are grounded, so that the paint droplets are electrostatically attracted to the objects 30. In addition, a flow of air in the painting direction 44 is maintained.

A portion of the paint that is ejected by the applicator 32 fails to be deposited upon the objects 30. The flow of air parallel to the direction 44, with the non-deposited paint entrained in the air flow, enters a filter 46, whose structure will be described subsequently. For the filter 46 to operate properly, the flow rate of the air and entrained paint entering the filter 46 is preferably at least about 100 linear feet per second. For an exemplary painting booth 12 having a cross sectional area perpendicular to the direction 44 of approximately 200 square feet, the total volume of air passing in the direction 44 must be about 12,000 cfm.

To achieve the required flow rate in the direction 44, the air that has passed through the filter 46 is recirculated to the upstream side of the paint applicator 32 through a recirculation duct 48 that extends from the low pressure or back side of the filter 46 to the high pressure side of the filter upstream of the paint applicator 32. A recirculation blower 58 in the recirculation duct 48 forces the air in that direction.

The duct 40 delivers its flow of make up air from the touch up booth 14 to the top of the automatic booth 12. The make up air therefore provides a portion of the volume of air that flows past the object 30. Air entering the system through the entrance opening 22, here indicated by the arrow 52, is added to the air flowing past the object 30. The negative pressure of the system draws air through the entrance opening 22, the air flow 52, at a rate sufficiently high that the linear rate of flow through the opening 22 exceeds that required to prevent organic vapors from flowing out of the booth 12 through the opening 22. For example, if the required linear rate of travel is 100 feet per minute to prevent loss of organics through the opening 22, and the opening is 10 square feet (e.g., 5 feet by 2 feet), the required flow rate of air inwardly through the opening 22 is about 1000 cfm.

Thus, the volume flow rate of air through the filter 46 is the sum of a continuously circulating volume of air, the volume of make up air from the duct 40, and the volume of air entering the opening 22.

Air is withdrawn from the recirculation duct 48 through an exhaust duct 54. The rate of removal through the exhaust duct 54 is controlled by two considerations. First, the volumetric flow rate in the duct 54 must, on the average, be equal to the sum of the volumetric flow rate of the makeup air entering the automatic painting booth 12 through the duct 40 and the volumetric flow rate of the air entering the automatic painting booth 12 through the opening 22. Second, the organic content of the air within the automatic painting booth 12 must be maintained below the lower explosive limit, and preferably well below the lower explosive limit. At least one organic content sensor 56 is operated within the automatic painting booth 12, to sense the volatile organic compound content of the air. If the organic content increases above the desired level, the rate of withdrawal of air through the exhaust duct 54 is increased. The pressure within the automatic painting booth 12 is slightly reduced, resulting in an increase in the rates of inflow of air through the duct 40 and the entrance opening 22. Alternatively, the conveyor 26 and/or the application rate of the paint application 32 may be slowed or stopped briefly, to allow the excess organic vapor to be evacuated from the automatic painting booth 12. Such a situation is highly unusual, and it is normally possible to operate with a volatile organic compound content of about 25 percent of the LEL.

Air is withdrawn from the recirculation duct 48 into the exhaust duct 54 by an exhaust blower 58. Additionally, a valve 60, such as the illustrated butterfly valve, is placed in the recirculation duct 48, preferably near the point at which the exhaust duct 54 is joined to the recirculation duct 48, to partially close either the duct 48 or the duct 54.

Ventilation air is drawn through the flash off tunnel 16 by a blower 62 disposed within an exhaust duct 64.

Similarly, ventilation air is drawn through the curing oven 18 by a blower 66 disposed within an exhaust duct 68. The organics loadings produced by the flash off tunnel 16 and the curing oven 18 are generally much lower than produced by the automatic painting booths 12 and the touch up booths 14, as are the required volumes of ventilation air. The ventilation air from the flash off tunnel 16 and the curing oven 18 are therefore preferably exhausted directly to the combustor 38, rather than through the automatic painting booth 12. Also, the hot air flow from the oven is preferably not introduced into the painting booths, except possibly when the ambient air temperature is so cold that the paint may not be applied properly. Alternatively, the ducts 64 and 68 could deliver their air flow to the automatic painting booths 12, in the manner of the ducts 40.

In the preferred embodiment, the organic-vapor containing air from the ducts 54, 64, and 68 is delivered to a common plenum 70, which conducts it to the combustor 38. The details of the combustor design are not within the scope of the present invention, and operable combustors having destruction efficiencies of up to about 98–99 percent are available commercially. However, the particular manner of handling the ventilation air and the organic vapor flows of the present invention permit a small sized combustor to be used, and also allow the organic-laden air flowing from the plenum to supply a large part of the heating value required to effect combustion and destruction.

The painting apparatus 10 also includes a control panel 90 that controls the various blowers and valves.

In a conventional approach for collecting and combusting the volatile organic compound content of the painting line that sprays 300 gallons of paint per day, about 60,000 cfm of organic-laden air at approximately 0.5 percent of LEL or less would be supplied to the combustor. A combustor sufficient to combust this flow at 1400° F. would cost about $1.0 million, and have a monthly fuel bill of about $50,000. A painting apparatus having the same capacity and constructed according to the present invention has a measured ventilation air flow of about 10,000 cfm (3400 cfm from each of two automatic painting booths, 1000 cfm from the flash off tunnel, and 2000 cfm from the curing oven) at an organics content of about 5 percent of LEL. The combustor sufficient to destroy the volatile organic compounds in this flow at 1400° F. costs about $250,000 and has a monthly fuel bill of about $5,000.

Equally importantly, the approach of the present invention permits the use of a high-organics content paint that produces a high quality finish on painted parts. Actual experience with a prototype apparatus has shown that the productivity of the apparatus is about 25 percent greater than the prior painting apparatus, due in large part to a large reduction in the number of parts that must be repainted to achieve an acceptable surface finish.

The present approach also permits a larger volume of painting without exceeding environmental limits than possible with the prior approach, so that, for example, more objects to be painted may be moved through the painting apparatus in a fixed time. The measured net efficiency of organics removal for the painting apparatus constructed according to the invention is 98.1 percent, which is obtained by multiplying the collection efficiency of 100 percent times the combustor efficiency of 98.1 percent. Using the SCAQMD legal limit discussed previously of 68 pounds of organic vapor emitted per day, the permissible equivalent lost gallons of paint for the high quality, 5.5 pound per gallon organic paint, is $68/(5.5\times0.019)$, or about 650 gallons per day. This figure is over 50 times the permissible paint usage for the case where all solvent is emitted to the atmosphere. The present approach permits the use of the paint that produces the best finish, in larger quantities than heretofore possible in a single installation while meeting emission limitations.

Figure 3:
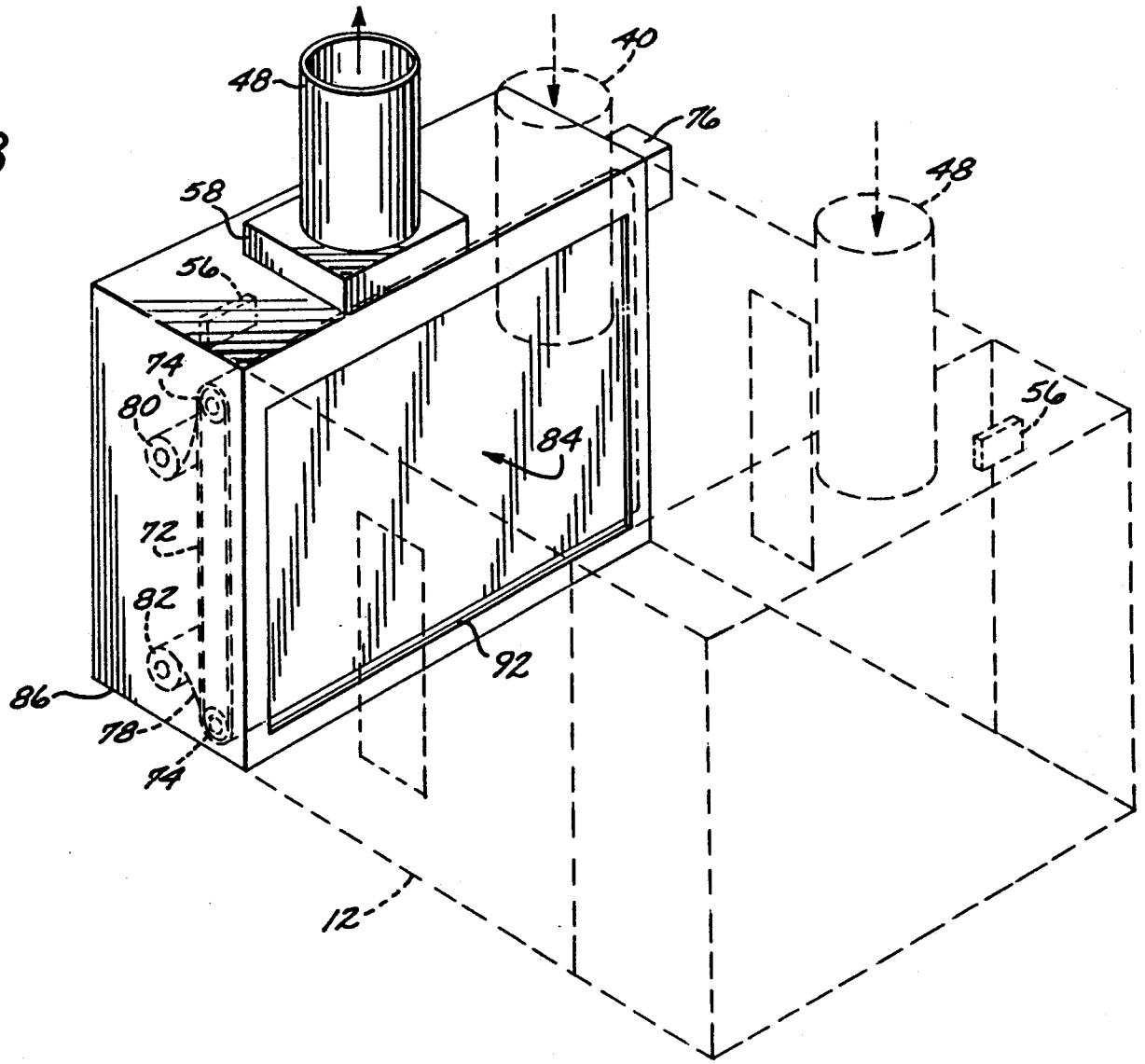
FIG. 3 is a perspective view of a filter apparatus useful for removing particulate from air, with an associated painting booth indicated in phantom lines.

The filter 46 has been discussed in relation to the painting booth 12 previously, in conjunction with FIG. 2. FIG. 3 depicts the structure of the filter 46 in more detail. The preferred filter 46 is of the incremental continuous filter type, some types of which have been previously available. In prior units, the filter 46 included a series of support rollers over which a semi-permeable filter strip passed. The filter strip was unwound from a payout roll, passed upwardly while supported on the support rollers, turned over an end roll, passed downwardly while supported on a second set of support rollers, and wound onto a takeup roll. In a typical case, the strip might contact a total of 24 rollers between the payout roll and the takeup roll. The strip, which is typically formed of a compressed fiber material, could stick to one or more of these support rollers. The takeup roll drive motor would then apply an increasing force to attempt to pull the strip free, with the result that the strip could break. A time-consuming shutdown of the entire system would result.

In the present filter 46, an endless belt 72 of a mesh material is passed over, and supported by, a pair of end rollers 74. The endless belt 72 has a mesh size on the order of 1 inch, and has an appearance like that of chain-link fencing. A commercial food sizing belt was used in a prototype filter 46. The end rollers 74 are turned by a controllable motor 76 acting through chain drives and gears as necessary. As the rollers 74 turn, the endless belt 72 moves.

A strip 78 of a semi-permeable fabric is supplied on a payout roll 80. The fabric strip material is preferably a non-woven, mat type polypropylene fabric paper formed of extruded polypropylene fibers that are bonded together with heat and pressure into a grid-like formation. Air under sufficient pressure can pass through the strip material, but paint particulate is trapped within the mat.

The fabric strip 78 is fed downwardly to be supported on one of the parallel planes of the endless belt 72, and moves downwardly while supported by the belt 72. After separation from the endless belt, the strip 78 is wound onto a takeup roll 82. The planar region of the strip 78, between the end rollers, constitutes a filtering region 84 through which particulate-containing air is forced by the slight vacuum, about 3 inches of water column, maintained on the back side of the filter relative to the front side. The pressure across the filter is sensed, and the motor 76 operated to expose new filter material when the pressure becomes too high, indicating a partially clogged filter. The filter material is advanced until the pressure falls to an acceptable value, and is then stopped. Further advance occurs when the pressure later rises to the upper limit.

A seal 92 is provided around the filtering region 84 so that the particulate-laden air flow must flow through the filtering region 84. The seal 92 is preferably out of the flight path of the particulate in the air flow, but provides a seal between the surface of the fabric strip 78 and the adjacent sheet metal. Particulates are filtered out to remain within the strip 78, while the air passes through and into the recirculation duct 48.

A key feature of the present approach for supporting the strip 78 is that it moves with the endless belt support, so that there is no opportunity for sticking of the strip material to stationary rotating rollers. If the strip material sticks to the endless belt, debonding occurs at only one location shortly before the strip is wound onto the takeup roll 82. The mesh of the endless belt is intentionally made coarse so that there will be few areas where the strip material might stick to the endless belt. The prototype filter experienced no sticking problems, while prior filters of the multi-support roller type discussed above were highly inefficient due to this problem. With the prior approach, the filter medium broke 3–4 times per day as a result of sticking. With the present approach, the filter strip 78 virtually never fails, and only routine maintenance 3–4 times per month is employed.

The components of the filter 46 are enclosed within a sheet metal housing 86 that is attached to the side of the automatic painting booth 12. In prior filters, the payout roll and the takeup roll were not so enclosed, for ease of access. The strip was therefore passed through slots in the housing to reach the interior of the filter. These slots have been found to introduce too high an air flow into the interior of the filter, interfering with the carefully planned ventilation air flow distribution discussed previously. The continuous sheet metal housing avoids this problem, and permits the air flows to be controlled in the manner described.

The motor 76 moves the endless belt by some predetermined amount in steps, as 6–10 inches per minute. Clean strip material is thereby introduced to the filtering regions 84, and gradually is transported by the endless belt 72 through the filtering regions 84 and to the takeup roll 82, slowly becoming saturated with the paint particulate that is filtered from the air. The rate of advance of the endless belt is selected so that the strip becomes loaded with paint particulate during its trip from the payout roll 80 to the takeup roll 82. The used strip is normally discarded.

The present approach has been demonstrated in a prototype facility to achieve high efficiencies of cleanup of the organics and particulate material from the applied paint, to meet health and safety laws, and to require minimal capital and operating costs. Although particular embodiments of the invention have been described in detail for purposes of illustration, various modifications may be made without departing from the spirit and scope of the invention. Accordingly, the invention is not to be limited except as by the appended claims.

What is claimed is:

1. Painting apparatus for painting objects passed therethrough continuously, comprising:

a first painting booth through which the objects pass and in which paint is applied in a first painting direction at a first paint flow rate, the first painting booth including means for recirculating a recirculation flow of air from one side of the first painting booth to the other, so that the air flows through the first painting booth in the first painting direction;

a second painting booth through which the objects pass after passing through the first painting booth, and in which paint is applied at a second paint flow rate;

means for forcing a makeup flow of air from the second painting booth to the first painting booth with a volume flow rate such that the organic content of the air in the second painting booth is less than its lower explosive limit;

withdrawal means for withdrawing a flow of air from the first painting booth; and control means for controlling the flow rate of air withdrawn by the means for withdrawing such that the organic content of the air in the first painting booth is less than its lower explosive limit.

2. The apparatus of claim 1, wherein the second painting booth has an access opening therein.

3. The apparatus of claim 1, wherein the apparatus contains a plurality of painting booths through which the objects pass.

4. The apparatus of claim 1, further including a particulate air filter through which the recirculation flow of air passes.

5. Painting apparatus for painting objects passed therethrough continuously, comprising:

a painting line, including an automatic painting booth having an automatic painting head therein that directs paint toward the objects to be painted in a painting direction, and having an entrance opening through which the objects pass to enter the painting line and which admits an entrance opening flow of air, but which is otherwise closed, a touch up booth having a manual painting head and an access opening providing access for a worker to the interior of the touch up booth to perform manual touch up operations, and which is joined to the automatic painting booth, a flash off tunnel through which the objects pass, and which is joined to the touch up booth, a curing oven through which the objects pass, and which is joined to the flash off tunnel, and further having an exit opening through which the objects pass to leave the painting line, and a conveyer upon which the objects are supported, and which conveys the objects through the automatic painting booth, the touch up booth, the flash off booth, and the curing oven, in that order; and an automatic painting booth ventilation system, including a recirculation duct that extends from one side of the automatic painting booth to the other, a recirculation blower that recirculates a recirculation flow of air through the recirculation duct and thence through the automatic painting booth in the painting direction, a makeup air duct extending from the touch up booth to the automatic painting booth, a makeup air blower that forces air through the makeup air duct, a collection plenum, a valve in the recirculation duct that permits a controllable volume of air to flow from the recirculation duct into the collection plenum, a filter through which the recirculation flow of air passes, means for forcing a flow of air from the flash off tunnel to the collection plenum, and means for forcing a flow of air from the curing oven to the collection plenum.

6. The apparatus of claim 5, further including at least one additional painting booth.

7. The apparatus of claim 5, further including at least one additional painting booth, and wherein at least one additional painting booth is placed between the automatic painting booth and the touch up booth.

8. The apparatus of claim 5, wherein the painting booths, the flash off tunnel, and the oven are arranged in a U-shaped plan.

9. A process for painting objects that pass through a painting apparatus in a continuous manner, comprising the steps of:

furnishing a first closed painting booth having an entry opening, the first painting booth having a painting applicator that forces organic-containing paint toward the objects in a first painting direction, and further having a semi-permeable paint filter through which the paint not deposited upon the objects is directed, a second painting booth connected to the first painting booth, the second painting booth having a painting applicator that sprays organic-containing paint toward the objects, and a conveyer that moves the objects into the first painting booth through the entry opening and thereafter into the second painting booth;

recirculating air through the first painting booth, the air flowing in the first painting direction within the first painting booth, at a rate sufficiently high to force paint-laden air through the filter;

providing a flow of make up air to the first painting booth from the second painting booth, the make up air being drawn from the second painting booth at a rate sufficiently high to prevent applied organics from escaping from the second painting booth; and withdrawing a portion of the recirculated air from the first painting booth at a rate such that the organics content of the air in the first painting booth is below the lower explosive level, such that the linear flow rate of air through the entry opening is sufficiently high to prevent sprayed organics from escaping from the second painting booth, and such that the volumetric flow rate of air withdrawn is substantially equal to the volumetric flow rate of make up air plus the volumetric flow rate of air entering the first painting booth through the entry opening.

* * * * *